US005410975A

United States Patent [19]

Dudek et al.

[11] Patent Number: 5,410,975

[45] Date of Patent: May 2, 1995

[54] APPARATUS FOR SEWING FABRIC PIECES TO SLIDE FASTENER CHAIN

[75] Inventors: Chet Dudek; Kiichiro Ishikawa, both of Marietta, Ga.

[73] Assignee: YKK Corporation, Tokyo, Japan

[21] Appl. No.: 166,839

[22] Filed: Dec. 15, 1993

[51] Int. Cl.[6] ..... D05B 3/22

[52] U.S. Cl. ..... 112/113; 112/121.27; 112/304

[58] Field of Search ..... 112/121.27, 104, 113, 112/272, 130, 304, 141, 142, 147

[56] References Cited

U.S. PATENT DOCUMENTS

| | | | |
|---|---|---|---|
| 2,131,250 | 9/1938 | De Voe . | |
| 2,977,904 | 4/1961 | Carmen . | |
| 3,286,669 | 11/1966 | Rockerath . | |
| 4,660,486 | 4/1987 | Arbter | 112/304 X |
| 4,674,422 | 6/1987 | Boser . | |
| 4,714,038 | 12/1987 | Boser . | |
| 4,996,933 | 3/1991 | Boser . | |
| 5,067,424 | 11/1991 | Ishikawa et al. | 112/121.27 X |
| 5,070,799 | 12/1991 | Montgomery et al. . | |

*Primary Examiner*—Clifford D. Crowder
*Assistant Examiner*—Paul C. Lewis
*Attorney, Agent, or Firm*—Hill, Steadman & Simpson

[57] ABSTRACT

An apparatus for sewing the opposed longitudinal edges of a pair of fabric pieces to a pair of stringer tapes of a continuous slide fastener chain along the outer longitudinal edges of the stringer tapes includes a support plate for supporting thereon the fabric pieces in parallel juxtaposition while the fabric pieces are delivered to said sewing station, a pair of parallel juxtaposed edge folders disposed longitudinally along a central portion of the support plate and extending downstream toward the sewing station for progressively folding over opposed longitudinal edges of the fabric pieces as the fabric pieces are advanced along the corresponding edge folders, and an endless belt drive unit, disposed in confrontation with the edge folders across the support plate and having a pair of endless belts frictionally engageable with a pair of parallel spaced portions, respectively, of the fabric pieces extending parallel to the edge folders, for positively feeding the fabric pieces toward the sewing station.

6 Claims, 5 Drawing Sheets

APPARATUS FOR SEWING FABRIC PIECES TO SLIDE FASTENER CHAIN

BACKGROUND OF THE INVENTION

1. Field of the Invention

The present invention relates to an apparatus for folding over the opposed longitudinal edges of a pair of fabric pieces or panels of an article and then sewing the folded longitudinal edges of the panels to a continuous slide fastener chain along the outer longitudinal edges of a pair of stringer tapes of the slide fastener chain having a row of interengaged coupling elements.

2. Description of the Prior Art

In the manufacture of a slide fastener sewn to the opposed longitudinal edges of a pair of fabric pieces or panels of an article, such as left and right front panels of a garment, or front and rear panels of a bag, the opposed longitudinal edges of the panels are folded over and the thus folded longitudinal edges of the panels are attached by sewing to the outer longitudinal edges of a pair of stringer tapes of a continuous slide fastener chain. Several examples of known apparatus used for performing the above-mentioned sewing operation are disclosed in U.S. Pat. Nos. 2,131,250, 2,977,904, 3,286,669, 4,674,422, 4,996,933 and 5,070,799. It is common to all the disclosed apparatus that a pair of parallel juxtaposed fabric pieces or panels of an article and a continuous slide fastener chain having a row of interengaged coupling elements are supplied concurrently to a double needle sewing machine. The sewing machine operates to attach the panels to the slide fastener chain by sewing the opposed longitudinal edges of the panels to the outer longitudinal edges of a pair of stringer tapes of the slide fastener chain. An edge-folding means is disposed upstream of the sewing machine and extends longitudinally along the path of supply of the panels for progressively folding back the opposed longitudinal edges of the panels as the panels are advanced toward the sewing machine. With the edge-folding means thus provided, the opposed longitudinal edges of the panels are supplied in a folded condition to the sewing machine. The thus folded longitudinal edges are then sewn to the outer longitudinal edges of the stringer tapes by the sewing machine.

The edge-folding means generally has a pair of spiraled or convoluted guide grooves extending from the upstream side to the downstream side of the path of feed of the panels. At an upstream end of the edge-folding means, the leading ends of the respective panels are set such that opposed longitudinal edges of the panels are received in the guide grooves. Then, the panels are advanced toward the sewing machine. As the panel advances, the opposed longitudinal edges received in the guide grooves are bent downwards, then progressively folded back toward the underside of the panels, and finally fully folded over in such a manner as to form a two-ply or folded longitudinal edges.

All the known apparatus except one disclosed in U.S. Pat. No. 4,674,422 have no means for guiding or directing the opposed longitudinal edges of the panels toward the edge-folding means. The edge-folding operation fully relies upon a pulling force produced during the advancing movement of the panels and hence is severely influenced by the flexibility of material of the panels. For instance, when the panels are relatively hard and inflexible, the opposed longitudinal edges of the panels being advanced are insufficiently drawn into the guide grooves in the edge-folding means. Conversely, when the panels are relatively soft and highly flexible, the opposed longitudinal edges of the panels are excessively drawn into the guide grooves in the edge-folding means. In either case, accurately folded longitudinal edges cannot be produced by the edge-folding means. Formation of the inaccurately folded longitudinal edges results in the panels inaccurately sewn to the slide fastener chain.

The apparatus disclosed in U.S. Pat. No. 4,674,422 includes a drive means for guiding the opposed longitudinal edges of a pair of fabric pieces or panels toward the edgefolding means. However, the drive means is only active on a leading end portion of the opposed longitudinal edges. Accordingly, those portions of the opposed longitudinal edges which extend parallel to and along the edge-folding means are freed from the action of the drive means. The apparatus further has a material directing means disposed adjacent to the edge-folding means. The material directing means is frictionally engageable with the panels for directing the opposed longitudinal edges of the panels toward the edge-folding means. However, since the material directing means is only operative in response to the advancing movement of the panels, the edge guiding effect of the material directing means is severely influenced by the flexibility of material of the panels. Accordingly, depending on the material of the panels, inaccurately folded longitudinal edges of the panels are likely to be produced in the same manner as described above. In addition, the apparatus is per se complicated in construction and uneasy to operate.

SUMMARY OF THE INVENTION

With the foregoing difficulties in view, it is an object of the present invention to provide an apparatus which is capable of accurately folding the opposed longitudinal edges of a pair of fabric pieces or panels, regardless of the material of the panels, and then sewing the accurately folded longitudinal edges to a continuous slide fastener chain along the outer longitudinal edges of a pair of stringer tapes of the slide fastener chain.

According to the present invention, there is provided an apparatus for sewing the opposed longitudinal edges of a pair of fabric pieces to a pair of stringer tapes of a continuous slide fastener chain along the outer longitudinal edges of the stringer tapes, slide fastener chain including a row of interengaged coupling elements, the apparatus comprising: (a) a sewing station having a pair of laterally spaced sewing needles providing a pair of longitudinally extending rows of stitches; (b) means disposed upstream of the sewing station for guiding the slide fastener chain longitudinally toward the sewing station; and (c) means disposed above the guiding means for delivering the fabric pieces toward the sewing station while holding the fabric pieces in parallel juxtaposition, the delivering means including (i) a support plate for supporting thereon the fabric pieces in parallel juxtaposition while the fabric pieces are delivered to the sewing station, (ii) a pair of parallel juxtaposed edge folders disposed longitudinally along a central portion of the support plate and extending downstream toward the sewing station for progressively folding over opposed longitudinal edges of the fabric pieces as the fabric pieces are advanced along the corresponding edge folders, and (iii) an endless belt drive unit, disposed in confrontation with the edge folders across the support plate and having a pair of endless belts frictionally engageable with a pair of parallel spaced portions, respectively, of the fabric pieces extending parallel to the edge folders, for positively feeding the fabric pieces toward the sewing station.

With this construction, the opposed longitudinal edges of the fabric pieces which are set on the delivering means can be automatically folded over with high accuracy regardless of the material of the fabric pieces, and subsequently the accurately folded longitudinal edges are sewn to the slide fastener chain. In addition, the apparatus is simple in construction and reliable in operation.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

The present invention is particularly useful when embodied in an apparatus for sewing two opposed panels of an article to a slide fastener chain.

Before proceeding with a description of the apparatus, an example of the article to be produced by the apparatus of the invention will first be described.

Figure 12:
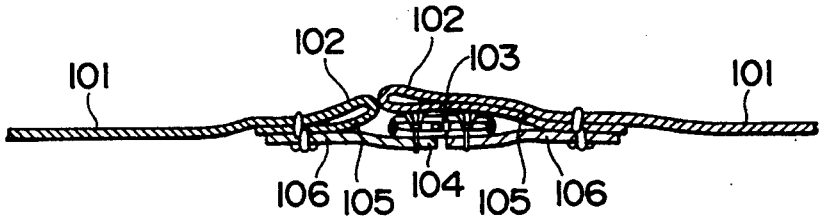
FIGS. 12 through 14 are transverse cross-sectional views of various articles produced by the apparatus of the present invention.

As shown in FIG. 12, a pair of fabric pieces or panels 101, 101, such as left and right front panels of a garment, or front and back panels of a bag, include two opposed longitudinal edges 102, 102 jointly forming an opening which is adapted to be opened and closed by a row of interengaged coiled coupling elements 103 of a slide fastener 104 sewn to the opposed longitudinal edges 102, 102 of the panels 101, 101. To improve the appearance of the article, and to avoid raveling of the panels 101, 101 at the longitudinal edges 102, 102, predetermined widths 105, 105 of the opposed longitudinal edges 102, 102 are folded back toward the underside of the panels 101, 101. The longitudinal edges 102, 102 thus folded are sewn to the outer longitudinal edges of the respective stringer tapes 106, 106. The row of coupling elements 103 is covered or concealed by one of the folded longitudinal edges 102, 102 of the panels 101.

Eligible materials for the panels 101, 101 include a woven fabric, a knitted fabric, a non-woven fabric, a leather, a leather fabric, a plastic sheet, etc.

Figure 1:
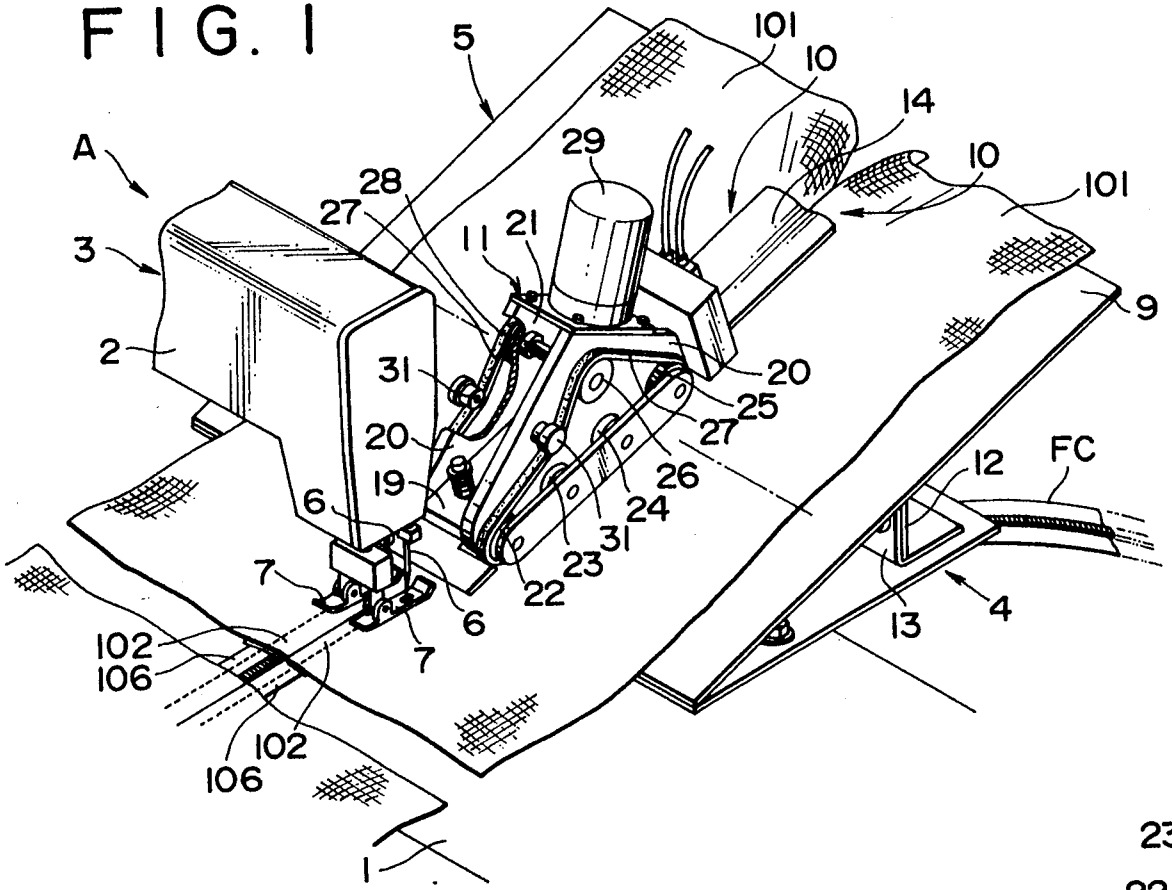
FIG. 1 is a perspective view, with parts cutaway for clarity, of a main portion of an apparatus according to the present invention.

The apparatus A, as shown in FIG. 1, generally comprises a sewing station 3 composed of a double needle sewing machine 2 mounted on a working bed or table 1, a guide means or unit 4 (better shown in FIG. 4) disposed upstream of the sewing station 3 for guiding a continuous slide fastener chain FC toward the sewing station 3, and a delivery means or unit 5 disposed above the guide unit 4 for feeding a pair of parallel elongated fabric pieces or panels 101, 101 synchronously toward the sewing station 3.

The sewing station 3 is constructed to sew opposed longitudinal edges 102, 102 of the respective panels 101, 101 to a pair of fastener stringer tapes 106, 106 of the slide fastener chain FC along outer longitudinal edges of the stringer tapes 106, 106. To this end, the sewing machine 2 of the sewing station 3 includes a pair of laterally spaced sewing needles 6, 6, and a pair of transversely spaced presser feet 7, 7 and a feed dog (not shown) that are associated with the corresponding sewing needles 6, 6 to feed the slide fastener chain FC. The sewing machine 2 is driven by an electric motor (not shown) which can be started and stopped in response to activation and de-activation of a foot switch (not shown). The construction of the sewing machine is known per se and, therefore, a further description thereof will be omitted.

Figure 6:
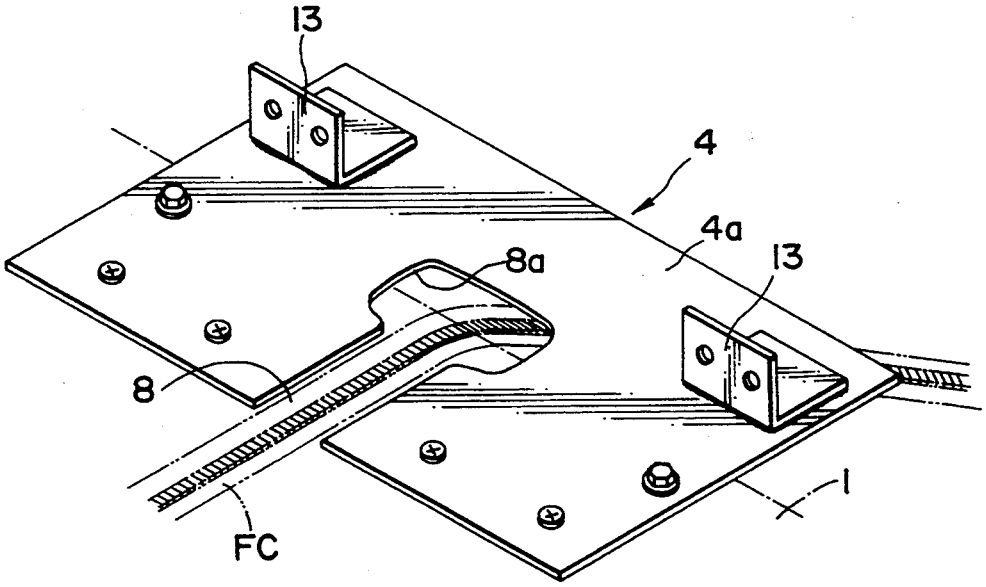
FIG. 6 is a perspective view of a guide plate of the apparatus shown in FIG. 1.

The guide unit 4, disposed upstream of the sewing station for guiding the slide fastener chain FC toward the sewing station 3, is composed of a flat rectangular guide plate **4*a* secured by screws to the working table 1, as shown in FIG. 6. The guide plate 4*a* has an elongated guide slot 8 extending from a downstream end near the sewing station 3 to a central portion of the guide plate 4*a* for guiding therealong the slide fastener chain FC as the slide fastener chain FC is supplied from a bobbin or a reel toward the sewing station 3. For providing a stable guiding effect, the width of the guide slot 8 is slightly larger than the width of the slide fastener chain FC. The slide fastener chain FC is fed by cooperative action of the presser feet 6, 6 and the feed dog, so that no means is provided on the guide unit side to perform the feeding of the slide fastener chain FC. The upstream end of the guide slot 8 which is located at the center of the guide plate 8 is enlarged as at 8*a* so as to facilitate setting of the slide fastener chain FC with respect to the sewing station 3**.

The delivery unit 5, disposed above the guide unit 4 for feeding the panels 101, 101 toward the sewing station 3, is constructed to progressively fold back predetermined widths 105, 105 of the opposed longitudinal edges 102, 102 of the panels 101, 101 while the panels 101, 101 are advanced until the these portions 105, 105 form two-ply or folded longitudinal edges 102, 102. To this end, the delivery unit 5 includes a support plate 9 (FIG. 5) for supporting thereon the panels 101, 101 in parallel juxtaposition for enabling the delivery of the panels 101, 101 toward the sewing station 3, a pair of parallel juxtaposed edge folding means or folders 10, 10

(FIGS. 3 and 4) disposed longitudinally along a central portion of the support plate 9 and extending downstream toward the sewing station 3 so as to fold over the opposed longitudinal edge portions 102, 102 of the panels 101, 101, respectively, and an endless belt drive unit 11 disposed in confrontation with the edge folders 10, 10 across the panels 101, 101 and frictionally engageable with respective portions of the panels 101, 101 extending parallel to, and spaced laterally outwardly from, the edge folders 10, 10 so as to force the panels 101, 101 toward the sewing station 3.

Figure 3:
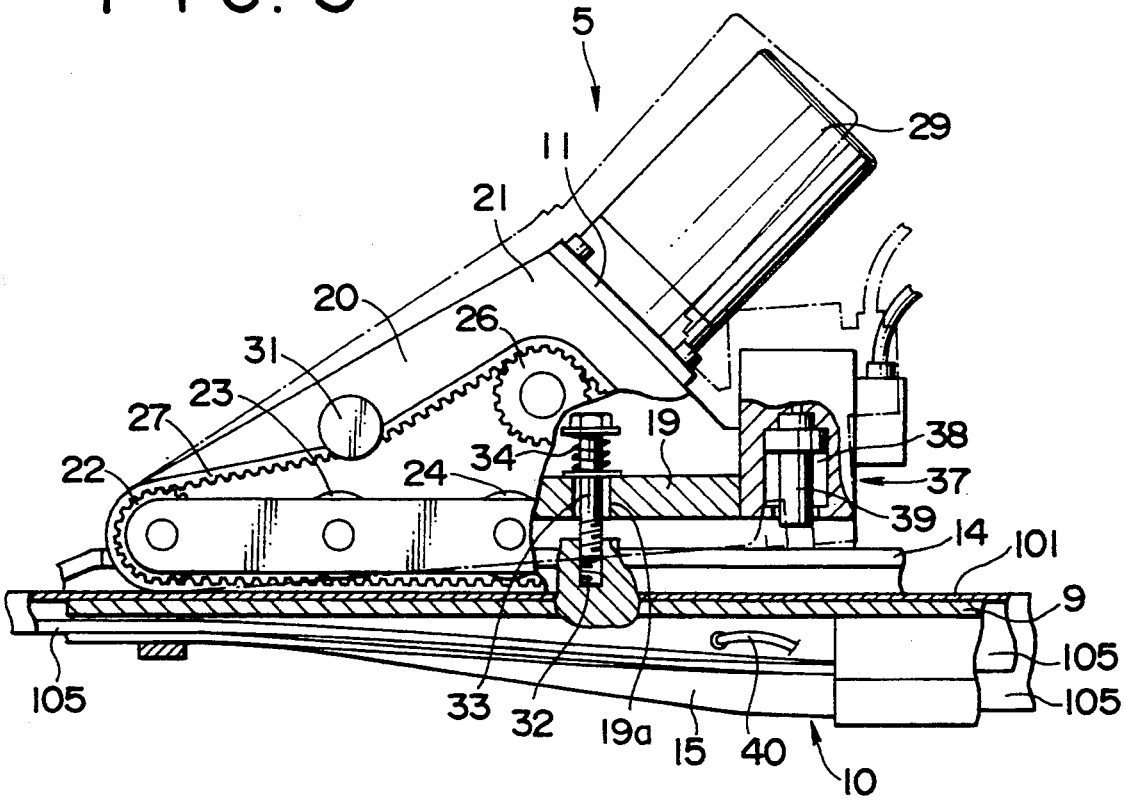
FIG. 3 is a front elevational view, with parts cutaway for clarity, of a feed unit of the apparatus shown in FIGS. 1.
Figure 4:
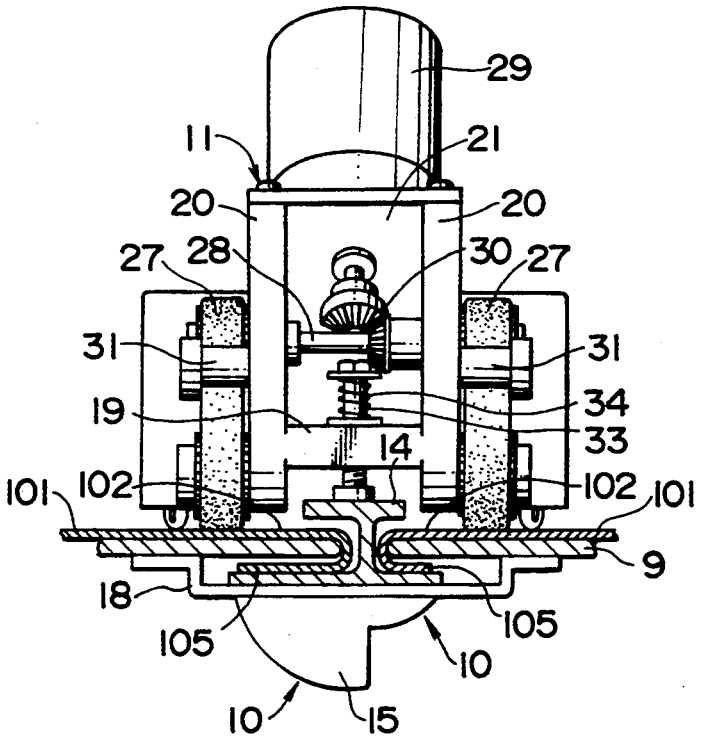
FIG. 4 is a left side view of FIG. 3.
Figure 5:
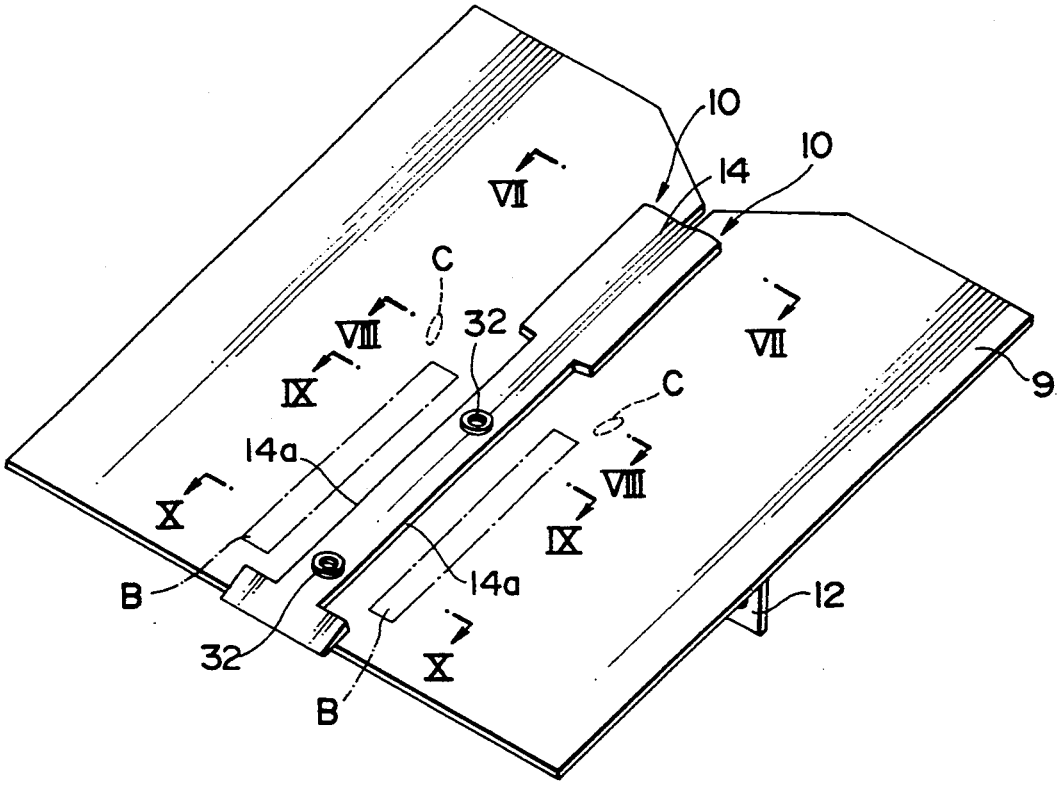
FIG. 5 is a perspective view of a table of the apparatus shown in FIG. 1.

The support plate 9 and the edge folders 10, 10 associated therewith will be described first in greater detail. As shown in FIG. 5, the support plate 9 comprises a substantially rectangular plate and has on its backside a pair of laterally spaced brackets 12 (only one shown) which is secured by a pair of screw fasteners (not shown), respectively, to a pair of laterally spaced brackets 13, 13 (FIG. 6) attached to the front surface of the guide plate 4*a*. The support plate 9 is supported on the guide plate 4*a* in an inclined posture such that the support plate 9 slops down toward the sewing station 3, as shown in FIG. 1. The downstream end of the support plate 9 and the downstream end of the guide plate 4*a* are located close to each other with a space or Gap which permits free passage of the slide fastener chain FC. The edge folders 10, 10 commonly have an elongate top plate 14 which is disposed above and extends along the central portion of the support plate 9. The top plate 14 extends from the downstream end toward the upstream end of the support plate 9 and terminates short of the upstream end of the support plate 9. The top plate 14 is longitudinally recessed at its opposite sides. The recessed longitudinal portions 14*a*, 14*a* have a predetermined length and are located closer to the downstream end of the top plate 14 than to the upstream end. As shown in FIGS. 3 and 4, the edge folders 10, 10 further have a common body or main portion 15 disposed below the top plate 14 and projecting downwardly from the support plate 9.

Figure 7:
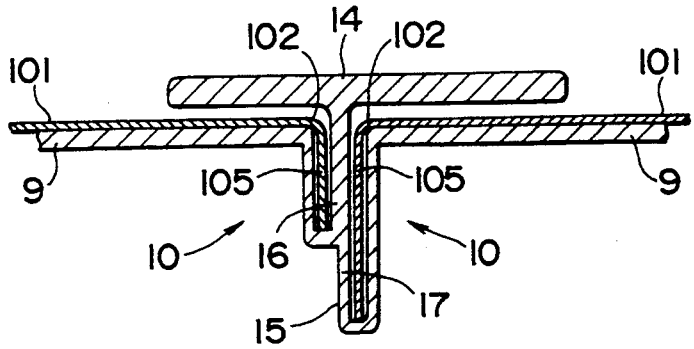
FIG. 7 is a cross-sectional view taken along line VII—VII of FIG. 5.
Figure 8:
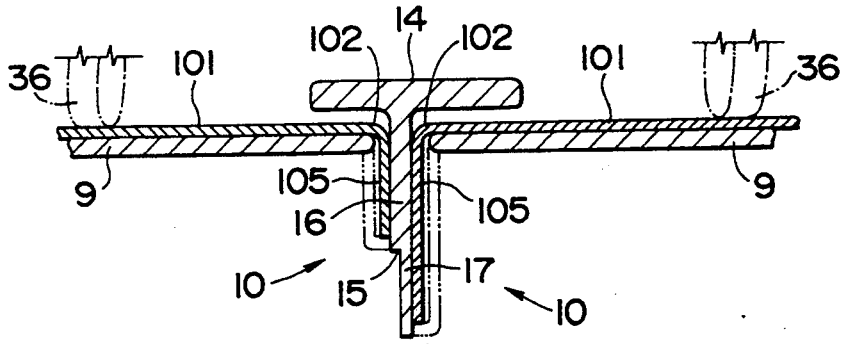
FIG. 8 is a cross-sectional view taken along line VIII—VIII of FIG. 5.
Figure 9:
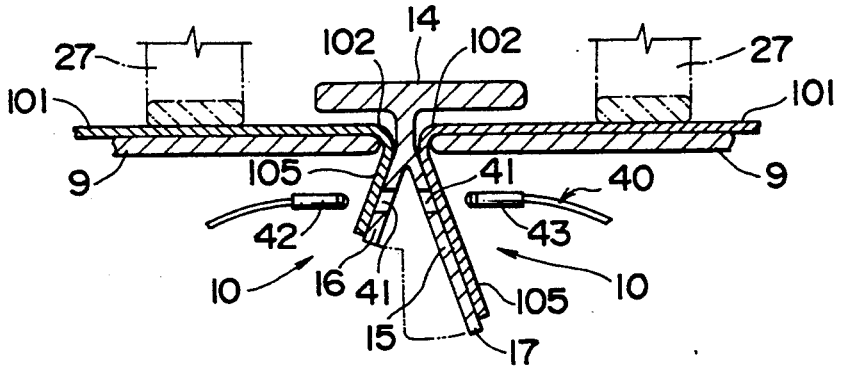
FIG. 9 is a cross-sectional view taken along line IX—IX of FIG. 5.
Figure 10:
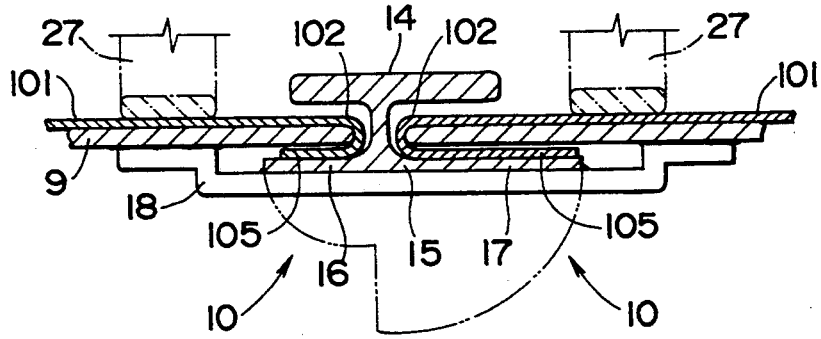
FIG. 10 is a cross-sectional view taken along line X—X of FIG. 5.

The common body 15 of the edge folders 10, 10 will be described in greater detail with reference to FIGS. 7–10 which illustrate transverse cross sections of the common body 15 taken along lines VII—VII, VIII—VIII, IX—IX and X—X of FIG. 5, respectively. The body 15 is composed of a pair of spiral Guide walls 16, 17 formed symmetrically with each other about a vertical plane and extending from the upstream end to the downstream end of the top plate 14. At their upstream ends, the Guide walls 16, 17 are integral with each other and bent into a Generally U shape integrally joined at opposite ends with the top plate 14 and the support plate 9, as shown in FIG. 7. Each of the U-shaped guide walls 16, 17 has a depth substantially equal to the width of a corresponding one of the longitudinal edge portions 105, 105 of the panels 101, 101. Thus, the longitudinal edge portions 105, 105 can be stably received in the corresponding U-shaped guide walls 16, 17 when the panels 101, 101 are manually set on the support plate 9. At a downstream position shown in FIG. 8, the guide walls 16, 17, still integral with each other, are separated from the support plate 9 and extend from the top plate 14 in a vertically downward direction. As further advanced toward their downstream ends, the guide walls 16, 17 are bifurcated and then bent or curved spirally in such a manner as to progressively separate away from each other, as shown in FIGS. 9 and 10. In the position shown in FIG. 10, the guide walls 16, 17 extend parallel to the support plate 9 and are supported on a bracket 18 attached to the underside of the support plate 9.

With the edge folders 10, 10 thus constructed, when the panels 101, 101 are set on the upstream end portion of the support plate 9, the leading end portions of the respective panels 101, 101 are bent downwardly along their inner longitudinal edges until the opposed longitudinal edge portions 105, 105 of the panels 101, 101 are fully received in the U-shaped guide walls 16, 17 of the edge folders 10, 10. Then, the endless belt drive unit 11 is driven whereupon the panels 101, 101 are positively fed downstream toward the sewing station 3. With this positive downstream feeding, the downwardly bent longitudinal edge portions 105, 105 are progressively folded back until they form two-ply or folded longitudinal edges 102, 102 of the panels 101, 101.

The apparatus shown in the illustrated embodiment is constructed to produce the article shown in FIG. 12. Since the opposed longitudinal edge portions 105, 105 of a pair of pieces of fabric 101 101 of the article have different widths, so that the U-shaped guide wall portions 16, 17 have different depths to accommodate the corresponding longitudinal edge portions 105, 105.

The endless belt drive unit 11, as shown in FIGS. 1–4, includes an elongated horizontal base plate 19 disposed above and extending along the recessed longitudinal portions 14*a*, 14*a* of the top plate 14, and a pair of substantially triangular vertical side plates 20, 20 joined with opposite sides of the base plate 19 so as to form, jointly with the base plate 19, a body 21 of the endless belt drive unit 11. Each of the side plates 20, 20 is provided with a plurality (four in the illustrated embodiment) of driven rollers 22, 23, 24 and 25 freely rotatably mounted along a lower side of the triangular side plate 20, and a drive roller 26 rotatably mounted adjacent an upper corner or apex of the triangular side plate 20. An endless belt 27 is trained around the drive and driven rollers 26, 22–25 that are mounted on each of the side plate 20. A portion of the endless belt 27 running along the lower side of the triangular side plate 20 is disposed in lateral juxtaposition with a corresponding one of the recessed portions 14*a*, 14*a* of the top plate 14 and extends parallel to a portion of a corresponding one of the edge folders 10, 10. This portion of the endless belt 25 is indicated by an elongated rectangular area B drawn by the phantom line shown in FIG. 5.

As shown in FIGS. 1 and 4, the drive rollers 26, 26 of the endless belt drive unit 11 are fixedly mounted on opposite ends of a drive shaft 28 journaled on the side plates 20, 20. The drive shaft 28 has an intermediate portion connected in driven relation with an electric motor 29 via a straight bevel gear drive 30 (FIG. 4). The electric motor 29 is mounted on the body 21 of the endless belt drive unit 11. With this arrangement, when the electric motor 29 is driven, the endless belts 27, 27 are caused to run around the rollers 22–26 in synchronism with each other. To produce a positive, non-slip driving effect, the drive rollers 26 and the endless belts 27 are composed of timing pulleys and timing belts, respectively. Furthermore, to enable a positive feeding of the panels 101, 101, the endless belts 27 are preferably made of synthetic rubber or synthetic resin which is capable of producing a sufficient friction when they are forced against the panels 101, 101 supported on the support plate 9. The electric motor 29 is preferably a stepping motor which is capable of operating in synchronism with the operation of the sewing machine 2 at the sewing station 3. Reference numeral 31 denotes a tension roller which is rotatably mounted on each of the side plate 20 and positionally adjustable to adjust the tension on the endless bent 27.

The endless belt drive unit 11 of the foregoing construction is mounted on the support plate 9 in the manner described below.

Figure 2:
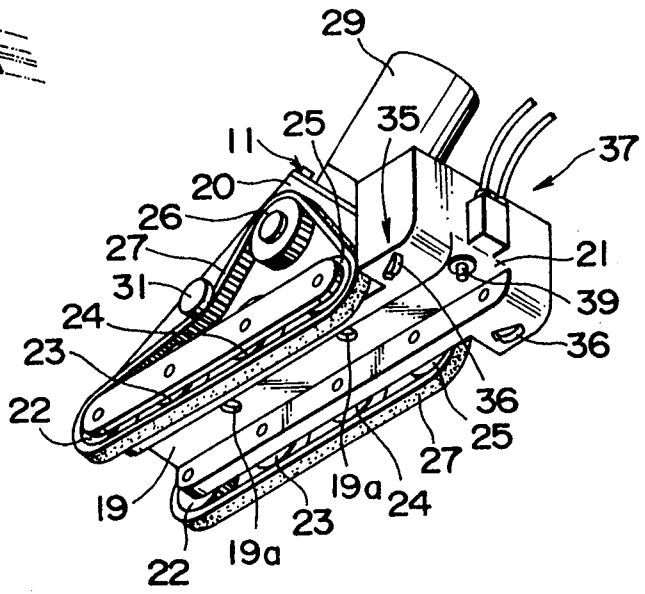
FIG. 2 is a perspective view showing an endless belt drive unit, as viewed from the bottom, of the apparatus shown in FIG. 1.

As shown in FIGS. 2 and 3, the elongate base plate 19 of the endless belt drive unit 11 has two holes 19*a*, 19*a* spaced in the longitudinal direction of the elongate base plate 19. The top plate 14 shown in FIG. 5 has two internally threaded holes 32, 32 spaced in the longitudinal direction of the top plate 14 by a distance which is equal to the distance between the holes 19*a*, 19*a* of the base plate 19. Two attachment screws 33 are threaded into the internally threaded holes 32, 32 of the top plate 14 through the holes 19*a*, 19*a* of the base plate 19, whereby the endless belt drive unit 11 can be mounted on the support plate 9. To secure a pressure contact between the endless belts 27 of the endless belt drive unit 11 and the panels 101, 101 set on the support plate 9, two compression coil springs 34, 34 (FIGS. 3 and 4) are disposed around the screws 33, 33 so as to act between the respective heads of the screws 33, 33 and the base plate 19 to urge the base plate 19 and the endless belt drive unit 11 as a whole downwardly toward the support plate 9.

The endless belt drive unit 11 further includes, as shown in FIG. 2, an auxiliary directing means 35 for directing the panels 101, 101 toward the edge folders 10, 10. The auxiliary directing means 35 comprises a pair of wheels 36, 36 disposed upstream of the endless belts 27, 27, respectively, and frictionally engageable with portions C, C (indicated by the phantom lines shown in FIG. 5) of the respective panels 101, 101. The wheels 36 are freely rotatably mounted on the body 21 of the endless belt drive unit 11 and rotatable about horizontal axes that are at an angle of about 10 degrees with the perpendicular to the longitudinal direction of sewing, and fabric movement.

With the auxiliary directing means 35 thus constructed, the opposed longitudinal edges 102, 102 are guided or directed forwardly and inwardly toward the corresponding edge folders 10, 10 by means of the wheels 36, 36 as the panels 101, 101 are advanced by the endless belts 27 of the endless belt drive unit 11.

As shown in FIGS. 2 and 3, the endless belt drive unit 11 includes a lift means 37 disposed upstream of the endless belts 27, 27 for lifting the upstream end of the endless belt drive unit 11 up from the support plate 19 against the force of the compression coil springs 34 so that the panels 101, 101 can be set between the support plate 9 and the endless belt drive unit 11. The lift means 37, as shown in FIG. 3, is composed of a fluid-pressure cylinder actuator such as an air cylinder 38 vertically mounted on the body 21 of the endless belt drive unit 11. The air cylinder 38 includes a piston rod 39 reciprocally movable toward and away from the upper surface of the support plate 9. The air cylinder 38 may be replaced by an electromagnetic solenoid.

With this arrangement, when the air cylinder 38 is activated to extend its piston rod 39, the upstream end of the endless belt drive unit 11 is lifted up until the endless belt drive unit 11 assumes its tilted position indicated by the phantom lines shown in FIG. 3. While endless belt drive unit 11 is kept in this tilted position, the panels 101, 101 are manually placed between the endless belt drive unit 11 and the support plate 9. When the panels 101, 101 are set completely, the air cylinder 38 is activated again to retract its piston rod 39 whereupon the endless belts 27, 27 of the endless belt drive unit 11 are forced into pressure contact with the panels 101, 101 under the force of the compression coil springs 34. Thus, when the endless belt drive unit 11 is driven, the endless belts 27, 27 run around the drive and driven rollers 22–26, thereby advancing the panels 101, 101 toward the sewing station 3 due to frictions acting between the endless belts 27, 27 and the panels 101, 101.

Now, a description will be given of a photosensor 40 which is associated with the body 15 of the edge-folding means 10, as shown in FIG. 9. The photosensor 40 is composed of a light projector 42 and a photocell 43 disposed in confrontation to one another with the guide walls 16, 17 of the body 15 disposed therebetween. The guide walls 16, 17 have a pair of horizontally aligned holes 41, 41, respectively, which is aligned with the light projector 42 and the photocell 43.

The photosensor 40 thus constructed detects the presence/absence of the opposed longitudinal edges 102, 102 of the panels 101, 101 at the edge-folding means 10. The photosensor 40 is operatively connected with the endless belt drive unit 11 and the sewing machine 2 to control the operation of these components 11, 2.

In the illustrated embodiment, the photosensor 40 is disposed immediately upstream of the contacting areas B, B (FIG. 5) of the endless belts 27, so that when the opposed longitudinal edges 102, 102 of the panels 101, 101 being advanced move past the photosensor 40, the photosensor 40 detects the absence of the longitudinal edges 102, 102 and, in response to this detection, the endless belt drive unit 11 and the sewing machine 2 are stopped. When the endless belt drive unit 11 and the sewing machine 2 are stopped, the advancing movement of the panels 101, 101 is stopped, with the trailing end edges of the panels 101, 101 located at the position indicated by the phantom line shown in FIG. 1. The phantom lined position corresponds to the position of the photosensor 40. Then, the lifting means 37 is activated so that the operator is able to set a next pair of pieces 101, 101 of fabric between the endless belt drive unit 11 and the support plate 9. It is, therefore, possible to produce an article having a number panel pairs 101, 101 sewn end to end along the outer longitudinal edges of the slide fastener chain FC.

All the movable components 2, 11, 37 of the apparatus A are operatively interlocked as described later.

Operation of the apparatus A will be described below in greater detail.

At first, a slide fastener chain FC is set with respect to the sewing station 3 of the sewing machine 2. In this instance, the leading end of the slide fastener chain FC is manually drawn into the guide slot 8 from the under side of the guide unit 4 and then guided along the guide slot 8 into a position between the pressure feet 7, 7 and the non-illustrated feed dog of the sewing machine 2. A foot switch (not shown) is depressed, the lifting means 37 is activated to lift the upstream end of the endless belt drive unit 11 up from the upper surface of the support plate 9, as indicated by the phantom lines shown in FIG. 3.

Then, a pair of fabric pieces or panels 101, 101 is manually set on the support plate 9, with each fabric piece 101 disposed on one side of the top plate 14, and with the leading end portions of the respective panels 101, 101 disposed between the lifted endless belt drive unit 11 and the support plate 9. In this instance, the opposed longitudinal edges 102, 102 of the panels 101, 101 are bent downwardly by predetermined widths until the downwardly bent longitudinal edge portions 105, 105 of the predetermined widths are fully received in the corresponding U-shaped guide walls 16, 17 of the edge folders 10, 10, as shown in FIG. 7.

Thereafter, the foot switch is depressed again to deactivate the lifting means 37 whereupon the endless belt drive unit 11 is lowered onto the panels 101, 101 set on the support plate 9. In this instance, by the resilient force of the compression coil springs 34 (FIG. 3), the endless belts 27, 27 are held in pressure contact with the upper surfaces of the panels 101, 101. Then, the electric motor 29 of the endless belt drive unit 11 and the non-illustrated electric motor of the sewing machine 2 are driven simultaneously. Since the endless belts 27, 27 extend parallel to and along the edge folders 10, 10, and since the endless belts 27, 27 are held in pressure contact with a pair of parallel spaced portions of the panels 101, 101, the panels 101, 101 are positively advanced by the endless belt drive unit 11 toward the sewing station 3 of the sewing machine 2 while they are held in accurate parallel juxtaposition. During that time, the longitudinal edge portions 105, 105 of the panels 101, 101 are advanced through the edge-folders 10, 10 while being guided by the guide walls 16, 17. Due to the convoluted configuration of the guide walls 16, 17, the longitudinal edge portions 105, 105, as they are advanced, are progressively folded back until they form two-ply or folded longitudinal edges 102, 102, as shown in FIGS. 7–10. The thus folded longitudinal edges 102, 102 of the panels 101, 101 are sewn to the slide fastener chain FC by a pair of rows of stitches formed at the sewing station 3.

When the trailing ends of the panels 101, 101 being advanced arrives at a position slightly downstream of the upstream ends of the respective endless belts 27, 27, the photosensor 40 detects the absence of the panels 101, 101. Upon this detection, the photosensor 40 issues a command signal to stop operation of the endless belt drive unit 11 and the sewing machine 2. In this instance, the trailing end edges of the panels 101, 101 are aligned with the phantom line shown in FIG. 1. Then, the lifting means 37 is activated, so that the endless belt drive unit 11 is lifted up from the support plate 9 until it assumes a tilted position indicated by the phantom lines shown in FIG. 3. Subsequently, a next pair of panels 101, 101 is set on the support plate 9 with their leading end edges located close to the trailing end edges of the preceding pair of panels 101, 101. Thereafter, the foregoing sequence of operation is repeated until a desired number of fabric piece pairs are sewn end to end to the slide fastener chain FC.

The apparatus A of the present invention has various advantages as described below. A pair of parallel spaced longitudinal portions of the panels 101, 101, which extend parallel to and along the corresponding edge folders 10, 10, are positively advanced by the endless belts 27, 27 of the endless belt drive unit 11 while the opposed longitudinal edge portions 105, 105 are stably held within the edge folders 10, 10 without displacement therefrom. Accordingly, as the panels 101, 101 are advanced toward the sewing station 3, the opposed longitudinal edge portions 105, 105 are progressively deformed into two-ply or folded longitudinal edges 102, 102 with high accuracy and reliability. With this positive feeding achieved by the endless belt drive unit 11, the opposed longitudinal edge portions 105, 105 of the panels 101, 101 can be accurately and reliably folded back into the two-ply, folded longitudinal edges 102, 102, regardless of the material of the panels 101, 101. The accurately folded longitudinal edges 102, 102 can, therefore, be sewn accurately and neatly to the slide fastener chain FC. Since the panels 101, 101 which are set under the endless belt drive unit 11 are automatically fed by the endless belt drive unit 11 toward the sewing station 3, the operator is no longer required to pay attention to the condition of the panels 101, 101 being advanced. The endless belt drive unit 11 is simple in construction and reliable in operation. Furthermore, by virtue of the auxiliary directing means 35 (skewed guide wheels 36, 36) disposed upstream of the endless belt drive unit 11, the panels 101, 101 while being advanced by the endless belt drive unit 11 are guided or directed inwardly toward the corresponding edge folders 10, 10. The auxiliary directing means 35 is particularly useful when the panels 101, 101 are relatively thick and inflexible, or relatively large in width and heavy in weight.

Figure 11:
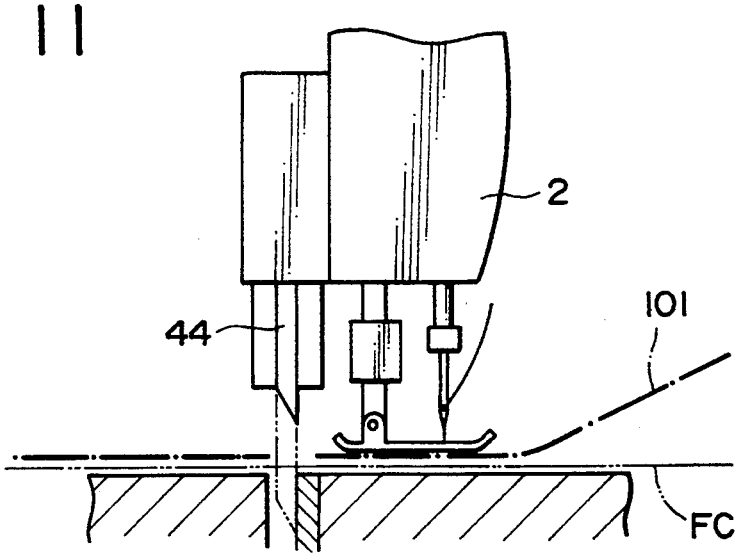
FIG. 11 is a front elevational view showing a sewing station according to another embodiment of the present invention.

The apparatus A described above is able to produce an elongate article which is composed of a continuous slide fastener chain FC and a number of pairs of panels 101, 101 sewn end to end to the slide fastener chain FC along the length thereof. The elongate article thus produced is thereafter severed by a suitable cutter across the slide fastener chain FC into individual slide fastener stringers each having one pair of panels. As an alternative, the apparatus A may further include a vertically reciprocating cutter 44 disposed downstream of the sewing machine 2, as shown in FIG. 11. When a gap between two adjacent panel pairs sewn to the slide fastener chain FC arrives at the position directly below the cutter 44, the operation of the sewing machine 2 and the endless belt drive unit 11 is temporarily stopped and, thereafter, the cutter 44 is vertically reciprocated, as indicated by the phantom lines shown in FIG. 11, so as to cut the slide fastener chain FC. Thus, individual slide fastener stringers each having one panel pair can be produced successively.

Figure 13:
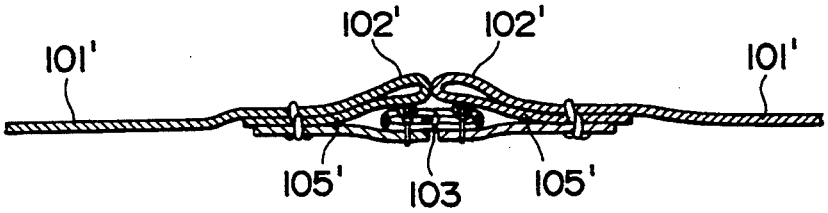
Figure 14:
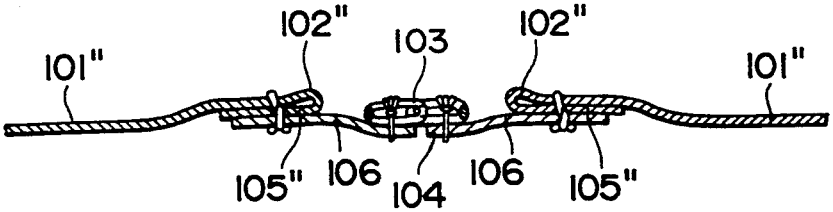

In the elongated article produced by the apparatus A described above, a row of interengaged coupling elements 103 of the slide fastener chain FC is covered or concealed by one of opposed folded longitudinal edges 101, 102 of the panels 101, 101, as shown in FIG. 12. By properly modifying the shape of the edge folders 10, 10, the apparatus A can also produce another elongated article which has, as shown in FIG. 13, a row of interengaged coupling elements 103 covered or concealed jointly and evenly by opposed folded longitudinal edges 102′, 102′ of the panels 101′, 101′ having the same width. In addition, the apparatus A is further possible, with a proper modification of the edge folders 10, 10, to produce an elongated article shown in FIG. 14. The article thus produced has a row of interengaged coupling elements 103 not covered with opposed folded longitudinal edges 102″, 102″ of the panels 101″, 101″. The folded longitudinal edges 102″, 102″ are smaller in width than those 102′, 102′ shown in FIG. 13 and sewn to the outer longitudinal edges of the corresponding slide fastener stringer tapes 106, 106 in laterally spaced relation to the row of interengaged coupling elements 103.

Obviously, various modifications and variations of the present invention are possible in the light of the above teaching. It is therefore to be understood that within the scope of the appended claims the invention may be practiced otherwise than as specifically described.

What is claimed is:

1. An apparatus for sewing the opposed longitudinal edges of a pair of fabric pieces to a pair of stringer tapes of a continuous slide fastener chain along the outer longitudinal edges of the stringer tapes, the slide fastener chain including a row of interengaged coupling elements, said apparatus comprising:

(a) a sewing station having a pair of laterally spaced sewing needles providing a pair of longitudinally extending rows of stitches;

(b) means disposed upstream of said sewing station for guiding the slide fastener chain longitudinally toward said sewing station; and (c) means disposed above said guiding means for delivering the fabric pieces toward said sewing station while holding the fabric pieces in parallel juxtaposition, said delivering means including (i) a support plate for supporting thereon the fabric pieces in parallel juxtaposition while the fabric pieces are delivered to said sewing station, (ii) a pair of parallel juxtaposed edge folders disposed longitudinally along a central portion of said support plate and extending downstream toward said sewing station for progressively folding over opposed longitudinal edges of the fabric pieces as the fabric pieces are advanced along the corresponding edge folders, and (iii) an endless belt drive unit, disposed in confrontation with said edge folders across said support plate and having a pair of endless belts frictionally engageable with a pair of parallel spaced portions, respectively, of the fabric pieces extending parallel to said edge folders, for positively feeding the fabric pieces toward said sewing station.

2. An apparatus according to claim 1, wherein said endless belt drive unit includes an auxiliary directing means disposed upstream of said endless belts for directing the fabric pieces toward said .edge folders while the fabric pieces are being fed by said endless belt drive means.

3. An apparatus according to claim 2, wherein said auxiliary directing means comprises a pair of wheels freely rotatable mounted on said endless belt drive unit and skewed at an angle toward the corresponding edge folders.

4. An apparatus according to claim 1, wherein said endless belt drive unit further includes a lift means disposed upstream of said endless belts for lifting said endless belt drive unit upwardly away from an upper surface of said support plate so as to accommodate a portion of the fabric pieces set between said endless belt drive unit and said support plate.

5. An apparatus according to claim 4, wherein said lifting means comprises a fluid-pressure cylinder actuator having a piston rod reciprocally movable into and out of contact with said upper surface of said support plate.

6. An apparatus according to claim 1, wherein said endless belts are timing belts, and said endless belt drive unit further includes a pair of timing pulleys meshing with said timing belts, respectively, and a power source for simultaneously rotating said timing pulleys.

* * * * *